US006387863B1

(12) United States Patent
Hazenkamp et al.

(10) Patent No.: US 6,387,863 B1
(45) Date of Patent: May 14, 2002

(54) PROCESS FOR TREATING TEXTILE MATERIALS

(75) Inventors: Menno Hazenkamp, Basel (CH); Frank Bachmann, Freiburg; Cornelia Makowka, Laufenburg, both of (DE); Marie-Josée Dubs, Wittersdorf (FR); Grit Richter, Neuenburg (DE); Gunther Schlingloff, Riehen (CH); Josef Dannacher, Basel (CH); Peter Weingartner, Diegten (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/914,865

(22) PCT Filed: Feb. 24, 2000

(86) PCT No.: PCT/EP00/01509

§ 371 Date: Sep. 4, 2001

§ 102(e) Date: Sep. 4, 2001

(87) PCT Pub. No.: WO00/53712

PCT Pub. Date: Sep. 14, 2000

(30) Foreign Application Priority Data

Mar. 8, 1999 (CH) ..... 0428/99

(51) Int. Cl.[7] ..... C11D 7/32; C11D 7/38; C11D 7/54

(52) U.S. Cl. ..... 510/311; 510/303; 510/372; 510/376; 252/186.29; 252/186.33

(58) Field of Search ..... 510/311, 303, 510/372, 376; 252/186.29, 186.33; 8/111, 137

(56) References Cited

U.S. PATENT DOCUMENTS

| | | | | |
|---|---|---|---|---|
| 5,688,758 A | * | 11/1997 | Reinehr et al. | 510/516 |
| 5,733,341 A | * | 3/1998 | Eckhardt et al. | 8/111 |
| 5,965,506 A | * | 10/1999 | Bacher et al. | 510/311 |
| 6,306,808 B1 | * | 10/2001 | Hazenkamp et al. | 510/224 |

FOREIGN PATENT DOCUMENTS

| | | |
|---|---|---|
| EP | 0157483 | 10/1985 |
| EP | 0630964 | 12/1994 |
| EP | 0693550 | 1/1996 |
| EP | 0718398 | 6/1996 |
| EP | 0902083 | 3/1999 |
| EP | 0955289 | 11/1999 |
| WO | 97/07192 | 2/1997 |

* cited by examiner

*Primary Examiner*—Gregory Delcotto
(74) *Attorney, Agent, or Firm*—Kevin T. Mansfield

(57) ABSTRACT

The inventions is drawn to mixtures of manganese complexes and organic ligands which significantly improve the bleaching effect of hydrogen peroxide in washing liquours and prevent the reabsorption of migrating dyes in peroxide-containing washing liquors.

11 Claims, No Drawings

PROCESS FOR TREATING TEXTILE MATERIALS

The present invention relates to mixtures of manganese complexes and organic ligands which significantly improve the bleaching effect of hydrogen peroxide in washing liquors and which prevent the reabsorption of migrating dyes in peroxide-containing washing liquors, to washing and cleaning agent formulations containing said mixtures, and to methods using such washing and cleaning agent formulations for cleaning and/or bleaching substrates and for preventing the reabsorption of migrating dyes in washing liquors.

Peroxide-containing bleaches have been used in washing and cleaning processes for some time. At a liquor temperature of 90° C. or more they are highly effective. As the temperature drops, however, their performance decreases markedly. It is known that diverse transition metal ions, added in the form of suitable salts or co-ordination compounds containing such cations, catalyse the degradation of $H_2O_2$. In this way it is possible to increase the bleaching effect of $H_2O_2$, or of precursors releasing $H_2O_2$ and also of other peroxide compounds, which effect is insufficient at lower temperatures. Important in practice are in this case only those combinations of transition metal ions and ligands, the peroxide activation of which is also expressed in an enhanced readiness to oxidise with regard to the substrate and not only in a catalase-like disproportionation, for the latter activation, which is unwanted in the present case, can further diminish the bleaching effects of $H_2O_2$ and its derivatives which are insufficient at low temperatures.

As regards bleaching-effective $H_2O_2$ activation, mono- and polynuclear variants of manganese complexes with diverse ligands, in particular with 1,4,7-trimethyl-1,4,7-triazazyclononane and, optionally, oxygen-containing bridging ligands, are held at present to be particularly effective. Such catalysts are sufficiently stable under practice conditions and contain the ecologically safe metal cation $Mn^{(n+)}$. However, their use entails substantial damage to dyes and fibres.

Surprisingly, it has now been found that in the case of certain manganese complexes the specific effect (i.e. the effect per mol of manganese complex) as catalysts for bleaching substrates and for preventing the reabsorption of migrating dyes in peroxide-containing washing liquors can be markedly enhanced if the manganese complex is mixed with a 0.2 to 50-fold molar amount of one or more than one organic ligand having a low molecular weight and if this mixture is used as catalyst in the washing process. This results in a synergistic effect between certain manganese complexes and certain organic ligands, not just in a simple addition of the individual effects: There are ligands which do not have any catalytic effect themselves but which can markedly enhance the specific catalytic effect of certain manganese complexes in a mixture. The catalytic effect per gramme of catalyst is then higher for the mixtures than for the pure manganese complexes and the risk of potential damage to dyes and fibres is reduced. In addition, the amounts of manganese required are smaller. Furthermore, mixtures of a manganese complex and the chemically corresponding ligand can be easily prepared by adding less than the equivalent amount of a manganese salt to a solution of the ligand in the complexing step.

Accordingly, this invention relates to a process for washing and cleaning and also for preventing the reabsorption of migrating dyes in a washing liquor, which process comprises adding to the washing liquor comprising a peroxide-containing washing agent 0.5 to 150 mg, preferably 1.5 to 75 mg, more preferably 1.5 to 30 mg, per liter of washing liquor of a mixture consisting of 2 to 85% by weight of a manganese complex and of 98 to 15% by weight of an organic ligand which can form a complex with manganese, the percentages being based on the entire weight of the mixture.

Manganese complexes suitable for the process of this invention are in particular compounds of formula (1)

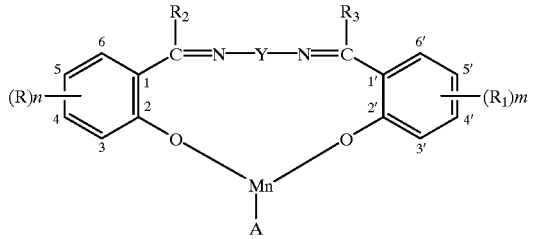

or (2)

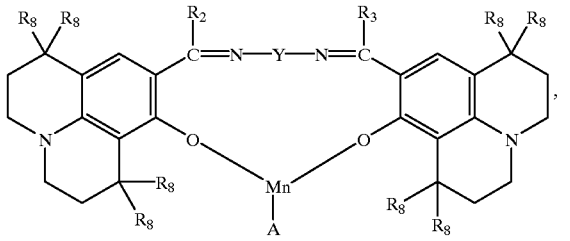

wherein

A is a anion;

n is 0, 1, 2 or 3, m is 0, 1, 2 or 3, $R_4$ is hydrogen or linear or branched $C_1$–$C_4$alkyl, $R_8$ is hydrogen or linear or branched $C_1$–$C_4$alkyl, Y is a linear or branched alkylene radical of formula —$[C(R_4)_2]_r$—, wherein r is an integer from 1 to 8 and the $R_4$ groups have each independently of one another the meanings cited above;

—CX=CX—, wherein X is cyano, linear or branched $C_1$–$C_8$alkyl or di(linear or branched $C_1$–$C_8$alkyl) amino, —$(CH_2)_q$—$NR_4$—$(CH_2)_q$—, wherein $R_4$ has the meaning cited above, and q is 1, 2, 3 or 4; or a 1,2-cyclohexylene radical of formula:

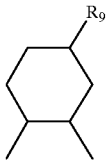

or a 1,2-aryl radical of formula

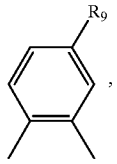

wherein $R_9$ is hydrogen, $SO_3H$, $CH_2OH$ or $CH_2NH_2$,

R and $R_1$ are each independently of the other cyano, halogen, $OR_4$ or $COOR_4$, wherein $R_4$ has the meaning cited above, nitro, linear or branched $C_1$–$C_8$alkyl, linear or branched partially fluorinated or perfluorinated $C_1$–$C_8$alkyl, $NR_5R_6$, wherein $R_5$ and $R_6$ are identical or different and are each hydrogen or linear or branched $C_1$–$C_{12}$alkyl, or linear or branched $C_1$–$C_8$alkyl-$R_7$, wherein $R_7$ is $NH_2$, $OR_4$, $COOR_4$ or $NR_5R_6$, which have the meanings cited above, or —$CH_2$—$N\oplus R_4R_6R_7$, or -$N\oplus R_4R_5R_6$, wherein $R_4$, $R_5$ and $R_6$ have the meanings cited above, $R_2$ and $R_3$ are each independently of the other hydrogen, linear or branched $C_1$–$C_4$alkyl or unsubstituted aryl, or aryl which is substituted by cyano, halogen, $OR_4$ or $COOR_4$, wherein $R_4$ is hydrogen or linear or branched $C_1$–$C_4$alkyl, by nitro, linear or branched $C_1$–$C_8$alkyl, $NHR_5$ or $NR_5R_6$, wherein $R_5$ and $R_6$ are identical or different and are each hydrogen or linear or branched $C_1$–$C_{12}$alkyl, or by linear or branched $C_1$–$C_8$alkyl-$R_7$, wherein $R_7$ is $NH_2$, $OR_4$, $COOR_4$ or $NR_5R_6$, which have the meanings cited above, or by —$N\oplus R_4R_5R_6$, wherein $R_4$, $R_5$ and $R_6$ have the meanings cited above.

If, in the compounds of formula (1), R and/or $R_1$ are defined as —$N\oplus R_4R_5R_6$ or —$CH_2$—$N\oplus R_4R_6R_7$ or $R_2$ and/or $R_3$ are defined as aryl which is substituted by —$N\oplus R_4R_5R_6$ or —$CH_2$—$N\oplus R_4R_6R_7$, wherein $R_4$, $R_5$ and $R_6$ have the meanings cited above, then suitable anions for balancing the positive charge at the —$N\oplus R_4R_5R_6$ or —$CH_2$—$N\oplus R_4R_6R_7$ group are halides, such as chloride, perchlorate, sulfate, nitrate, hydroxide, $BF_4^-$, $PF_6^-$, carboxylate, acetate, tosylate or triflat. Bromide and chloride are preferred.

In those compounds of formula (1) wherein n is 2 or 3, the R groups may have the same or different meanings. The same applies to the compounds of formula (1), wherein m is 2 or 3, with respect to the $R_1$ groups.

Y defined as a 1,2-cyclohexylene radical may be in any of its stereoisomeric cis/trans forms.

Y is preferably a radical of formula —$(CH_2)_r$—, wherein r is an integer from 1 to 8, or of formula —$C(R_4)_2$—$(CH_2)_p$—$C(R_4)_2$—, wherein p is a number from 0 to 6, preferably from 0 to 3, and the $R_4$ groups are each independently of one another hydrogen or $C_1$–$C_4$alkyl, preferably hydrogen or methyl, or a 1,2-cyclohexylene radical or a 1,2-phenylene radical of formula:

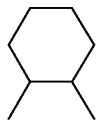

or

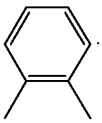

Halogen is preferably chloro, bromo or fluoro. Chloro is particularly preferred.

If n or m is 1, the R and $R_1$ groups are preferably in 4-position of the respective benzene ring unless R or $R_1$ is nitro or $COOR_4$. In this case the R or $R_1$ group is preferably in 5-position. If R or $R_1$ is $N\oplus R_4R_5R_6$, the R or $R_1$ group is preferably in 4- or 5-position.

If n or m is 2, the two R or $R_1$groups are preferably in 4,6-position of the respective benzene ring unless R or $R_1$ are nitro or $COOR_5$. In this case the two R or $R_1$ groups are preferably in 3,5-position.

If R or $R_1$ are di($C_1$–$C_{12}$alkyl)amino, the alkyl group may be straight-chain or branched. This group preferably contains 1 to 8 carbon atoms, more preferably 1 to 3 carbon atoms.

R and $R_1$ are preferably hydrogen, chloro, $OR_4$, $COOR_4$, $N(R_4)_2$ or $N\oplus(R_4)_3$, wherein in $N(R_4)_2$ or $N\oplus(R_4)_3$ the $R_4$ groups may be different and are hydrogen or $C_1$–$C_4$alkyl, preferably methyl, ethyl or isopropyl.

$R_2$ and $R_3$ are preferably hydrogen, methyl, ethyl or unsubstituted phenyl.

Aryl is typically naphthyl or, preferably, phenyl.

Suitable anions A are, for example, halides such as chloride or bromide, perchlorate, sulfate, nitrate, hydroxide, $BF_4^-$, $PF_6^-$, carboxylate, acetate, tosylate or triflat. Chloride, bromide and acetate are preferred.

Suitable organic ligands used in the novel mixtures of a manganese complex and an organic ligand are preferably compounds of formula (3)

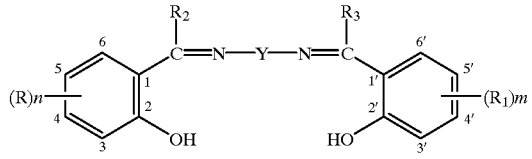

or (4)

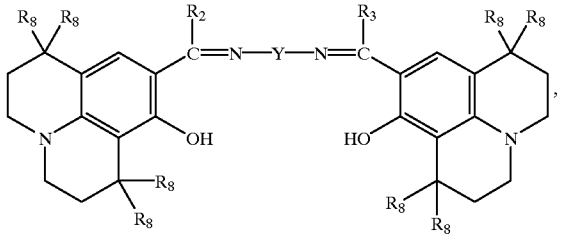

wherein R, $R_1$, $R_2$, $R_3$, $R_4$, $R_8$, Y, n and m have the meanings cited for formulae (1) and (2).

The preferred definitions of R, $R_1$, $R_2$, $R_3$, $R_4$, $R_8$, Y, n and m given for the manganese complexes of formula (1) and (2) are also preferred in the case of the ligands of formula (3) and (4).

Other compounds suitable for use as organic ligands in the novel mixtures are those of formula (5)

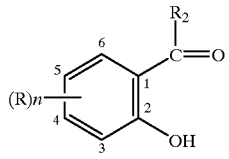

or

-continued (6)

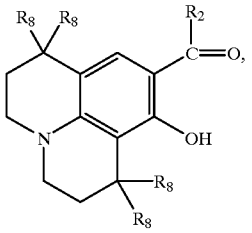

wherein R, $R_2$, $R_8$ and n have the meanings cited for formulae (1) and (2).

The preferred definitions of R, $R_2$, $R_8$ and n given for the manganese complexes of formulae (1) and (2) are also preferred in the case of the ligands of formula (5) and (6).

The compounds of formula (1)–(6) are known or can be prepared in a manner known per se. The manganese complexes are prepared, for example, from the corresponding ligands (2) and (3) and a manganese compound. Such methods of preparation are described, inter alia, in U.S. Pat. Nos. 5,281,578 and 4,066,459 and in Bernardo et al., Inorg. Chem. 45 (1996) 387.

The compounds of formula (1) or (2) can be used singly or in admixture with two or more additional compounds of formula (1) or (2). Likewise, the ligands of formulae (3) to (6) can be used singly or in admixture with two or more additional ligands.

The ratio $$V = \frac{\text{entire amount of the manganese complexes in the mixture}}{\text{entire amount of the organic ligands in the mixture}}$$

in the mixtures used according to this invention is preferably from 0.02 to 5, more preferably from 0.02 to 1. The amounts are based on molar amounts.

This invention also relates to a washing agent, which comprises

I) 5–90%, preferably 5–70%, A) of an anionic surfactant and/or B) of a nonionic surfactant, II) 5–70%, preferably 5–50%, more preferably 5–40%, C) of a builder substance, III) 0.1–30%, preferably 1–12%, D) of a peroxide, and IV) 0.005–2%, preferably 0.02–1%, more preferably 0.05–0.5%, E) of a mixture of a manganese complex of formula (1) or (2) and an organic ligand of formula (3), (4), (5) or (6), the percentages being by weight, based on the entire weight of the washing agent.

It is possible to mix the manganese complexes and the organic ligands first and then to mix the resulting mixture E) with the other washing agent components A), B), C) and D). However, it is also possible to mix the manganese complexes and the organic ligands individually with the remaining washing agent components A), B), C) and D).

The washing agent may be in solid or in liquid form, for example in the form of a liquid non-aqueous washing agent, comprising not more than 5% by weight, preferably from 0 to 1% by weight of water, and as basis a suspension of a builder substance in a nonionic surfactant, as is described e.g. in GB-A-2,158,454.

Preferably, however, the washing agent is obtained in powdered or granulated form.

The washing agent may be produced, for example, by first preparing a starting powder by spray-drying an aqueous slurry, containing all of the above-cited components except the components D) and E), and then adding the dry components D) and E) and mixing all of these components.

It is also possible to add the component E) to an aqueous slurry containing the components A), B) and C) and, after spray-drying this mixture, mixing the component D) with the dry mixture.

It is also possible to start from an aqueous slurry which contains the components A) and C), but not, or only partially, component B). After spray-drying the slurry, the component E) is mixed with the component B) and added thereto, and the component D) is then admixed in dry form.

The anionic surfactant A) may be, for example, a sulfate, sulfonate or carboxylate surfactant, or a mixture thereof.

Preferred sulfates are those which contain 12–22 carbon atoms in the alkyl radical, optionally in combination with alkylethoxysulfates, the alkyl radical of which contains 10–20 carbon atoms.

Preferred sulfonates are, for example, alkylbenzenesulfonates containing 9–15 carbon atoms in the alkyl radical.

The cation in the anionic surfactants is preferably an alkali metal cation, most preferably sodium.

Preferred carboxylates are alkali metal sarcosinates of formula R—CO—N($R^1$)—$CH_2COOM^1$, wherein R is alkyl or alkenyl containing 8–18 carbon atoms in the alkyl or alkenyl radical, $R^1$ is $C_1$–$C_4$alkyl, and $M^1$ is an alkali metal.

The nonionic surfactant B) may be, for example, a condensate of 3–8 mol of ethylene oxide with 1 mol of primary alcohol containing 9–15 carbon atoms.

Suitable builder substances C) are, for example, alkali metal phosphates, preferably tripolyphosphates, carbonates or bicarbonates, more preferably their sodium salts, silicates, aluminium silicates, polycarboxylates, polycarboxylic acids, organic phosphonates, aminoalkylenepoly (alkylenephosphonates), or mixtures of these compounds.

Particularly suitable silicates are the sodium salts of crystalline sheet silicates of formula $NaHSi_tO_{2t+1}.pH_2O$ or $Na_2Si_tO_{2t+1}.pH_2O$, wherein t is a number from 1.9 to 4 and p is a number from 0 to 20.

Preferred aluminium silicates are those which are commercially available under the names Zeolite A, B, X and HS, and also mixtures comprising two or more of these components.

Preferred polycarboxylates are the polyhydroxycarboxylates, in particular citrates, and acrylates as well as their copolymers with maleic anhydride.

Preferred polycarboxylic acids are nitrilotriacetic acid, ethylenediaminetetraacetic acid and ethylenediaminedisuccinate both in racemic form and in the enantiomerically pure S,S-form.

Particularly suitable phosphonates or aminoalkylenepoly (alkylenephosphonates) are the alkali metal salts of the 1-hydroxyethane-1,1-diphosphonic acid, nitrilotris (methylenephosphonic acid), ethylenediaminetetramethylenephosphonic acid and diethylenetriaminepentamethylenephosphonic acid.

Suitable peroxide components D) are, for example, the organic and inorganic peroxides which are known in the literature and available on the market, which bleach textile materials at the standard washing temperatures, for example from 10 to 95° C.

The organic peroxides are, for example, mono- or polyperoxides, preferably organic peracids or the salts thereof, such as phthalimidoperoxycapronic acid, peroxybenzoic acid, diperoxydodecane diacid, diperoxynonane diacid, diperoxydecane diacid, diperoxyphthalic acid or the salts thereof.

However, it is preferred to use inorganic peroxides, for example persulfates, perborates, percarbonates and or persilicates. It is of course also possible to use mixtures of inorganic and/or organic peroxides. The peroxides can be obtained in different crystal forms and may have different water contents, and they may also be used together with other inorganic or organic compounds in order to improve their storage stability.

The peroxides are preferably added to the washing agent by mixing the components, for example by means of a screw feeding system and/or a fluidised bed mixer.

In addition to the novel combination, the washing agents may contain one or more than one fluorescent whitening agent, for example from the class of the bis-triazinylaminostilbenedisulfonic acid, bis-triazolylstilbenedisulfonic acid, bis-styrylbiphenyl or bis-benzofuranylbiphenyl, a bis-benzoxazolyl derivative, bis-benzimidazolyl derivative, coumarine derivative or a pyrazoline derivative.

The washing agents may also contain suspending agents for dirt, e.g. sodium carboxymethylcellulose, pH-regulators, e.g. alkali or alkaline earth metal silicates, foam regulators, e.g. soaps, salts for regulating the spray-drying and the granulation properties, e.g. sodium sulfate, fragrances and, optionally, antistatic agents and softeners, enzymes, such as amylase, bleaches, pigments and/or shading agents. These components must, of course, be stable against the bleaching agent used.

Other additives preferably added to the novel washing agents are polymers which prevent staining during the washing of the textiles through dyes that are present in the washing liquor and that have separated from the textiles under the washing conditions. These polymers are preferably polyvinylpyrrolidones, which are unmodified or modified through the incorporation of anionic or cationic substituents, in particular those having a molecular weight in the range from 5000 to 60000, more preferably from 10000 to 50000. These polymers are preferably used in an amount of 0.05 to 5% by weight, more preferably of 0.2 to 1.7% by weight, based on the entire weight of the washing agent.

The washing agents may additionally contain so-called perborate activators, such as TAED or TAGU. TAED is preferred and is preferably used in an amount from 0.05 to 5% by weight, more preferably from 0.2 to 1.7% by weight, based on the entire weight of the washing agent.

The following non-limitative Examples illustrate the invention in more detail. Parts and percentages are by weight, unless otherwise stated.

EXAMPLE 1

To determine the effectivity of the catalysts, the DTI-effectivity is measured. The DTI (Dye transfer inhibition)-effectivity a is defined as the following percentage:

$$a=([Y(E)-Y(A)]/[Y(W)-Y(A)])*100,$$

wherein Y(W), Y(A) and Y(E) denote the CIE-brightnesses of the white material, of the material treated without addition of a catalyst and of the material treated with addition of the catalyst, in that order. a=0 characterises a completely useless product, the addition of which to the washing liquor gives free rein to dye transfer. a=100% in turn corresponds to a perfect catalyst which completely inhibits staining of the white material.

The following test system is used to obtain the test data: 7.5 g of a white cotton fabric are treated in 80 ml of a washing liquor. This liquor contains the standard washing agent ECE phosphate-free (456 IEC) EMPA, Switzerland, in a concentration of 7.5 g/l, 8.6 mmol/l of $H_2O_2$ and a solution of the test dye. The washing process takes place in a beaker in a LINITEST apparatus over 30 min at 40° C. The catalyst is added in the respective concentration indicated.

Commercially available Direct Brown 172 (dye 1) with 10 mg/l of the 250% formulation or Reactive Blue 238 (dye 2) with 6 mg/l of the 100% formulation are used as test dyes. The reflection spectra of the samples are measured using a SPECTRAFLASH 2000 and are transformed by the standard procedure according to CIE into brightnesses (D65/10).

The following manganese complexes and ligands are used:

(1a)

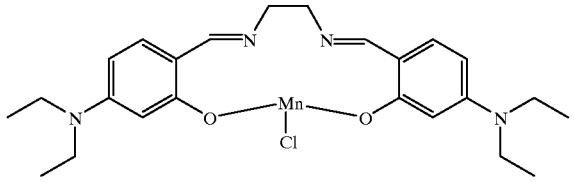

(3a)

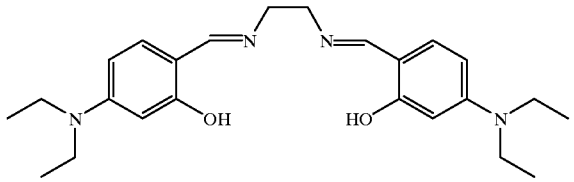

(3b)

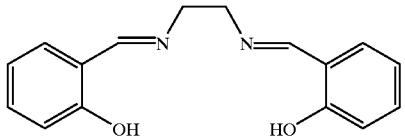

(3c)

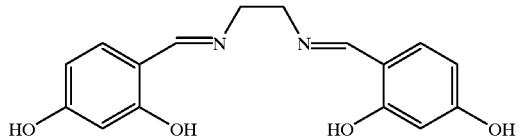

(3d)

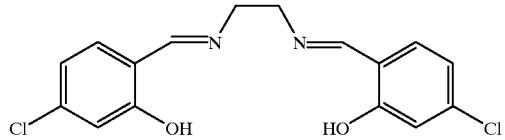

(5a)

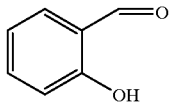

-continued (5b)

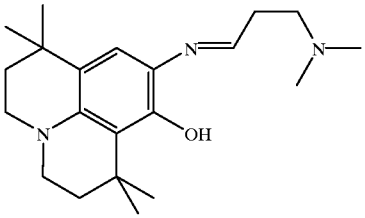

Table 1 shows the DTI-effects a (%) of complexes and mixtures consisting of manganese complexes and organic ligands comprising compounds of formulae (1a), (3a), (3b), (3c), (3d), (5a) and (5b). The concentrations of the individual components of the mixtures in the washing liquors are listed in the first column. The conditions for use are as described above. Table 1 shows that the DTI-effects a are, in principle, not addable: For dye 2, 5 μmol/L of (1a) have a DTI-effect of 68%, 45 mol/L of (5b) have a DTI-effect of 9%, while the mixture of (1a) and (5b) only has an effect of 25%. The synergistic effects are particularly clear for ligand (5a) which itself shows no DTI-effect at a concentration of 90 μmol/L, but which has a significantly better effect in combination with 5 μmol/L of the manganese complex (1a) than when 5 μmol/L of (1a) are used on their own. Table 1 shows that the DTI-effect of a binary mixture of manganese complex and organic ligand, where the manganese complex is used in the washing liquor at a concentration of only 5 or 6 μmol/L, is virtually equally good as the effect of the manganese complex on its own when used in a concentration of 50 μmol/L.

TABLE 1

| Catalyst (mixture) | DTI-Effect a (%) Dye 1 | DTI-Effect a (%) Dye 2 |
|---|---|---|
| 50 μmol/L of (1a) | 93 | 92 |
| 5 μmol/L of (1a) | 68 | 68 |
| 45 μmol/L of (3a) | 31 | 24 |
| 5 μmol/L of (1a) + 5 μmol/L of (3a) | 82 | 86 |
| 6 μmol/L of (1a) + 14 μmol/L of (3a) | 83 | 91 |
| 5 μmol/L of (1a) + 45 μmol/L of (3a) | 88 | 91 |
| 45 μmol/L of (3b) | 5 | 9 |
| 5 μmol/L of (1a) + 45 μmol/L of (3b) | 89 | 85 |
| 45 μmol/L of (3c) | 15 | 16 |
| 5 μmol/L of (1a) + 45 μmol/L of (3c) | 82 | 84 |
| 45 μmol/L of (3d) | — | 34 |
| 5 μmol/L of (1a) + 45 μmol/L of (3d) | — | 87 |
| 90 μmol/L of (5a) | — | 0 |
| 5 μmol/L of (1a) + 90 μmol/L of (5a) | — | 86 |
| 45 μmol/L of (5b) | — | 9 |
| 5 μmol/L of (1a) + 45 μmol/L of (5b) | — | 25 |

EXAMPLE 2

Table 2 shows that a mixture of manganese complex (1a) (concentration in the washing liquor 5 μmol/L) and ligand (3a) (concentration in the washing liquor 45 μmol/L) very effectively prevents the reabsorption of dyes of different classes. The conditions of the experiment and the structures of the compounds (1a) and (3a) are described in Example 1.

TABLE 2

| Test dye | Dye concentration mg/l | DTI-Effect a (%)) |
|---|---|---|
| Direct Brown 172 250% | 10 | 88 |
| Reactive Blue 238 100% | 6 | 91 |
| Reactive Black 005 133% | 12 | 77 |
| Direct Black 022 400% | 6 | 77 |
| Reactive Blue 019 Special 100% | 20 | 95 |
| Acid Blue 113 180% | 6 | 93 |
| Disperse Violet 001 100% | 6 | 89 |

EXAMPLE 3

The novel mixtures significantly improve the bleaching effect of hydrogen peroxide in washing liquors, whereas the pure complexes do not, or only little, improve the bleaching result. The bleaching tests are carried out as follows: 7.5 g of a white cotton fabric and 2.5 g of a cotton fabric with tea stains are treated in 80 ml of a washing liquor. This liquor comprises the standard washing agent ECE phosphate-free (456 IEC) EMPA, Switzerland, in a concentration of 7.5 g/l and the oxidants, catalysts and, optionally, activators in the concentrations listed in the corresponding Tables. The washing process takes place in a steel beaker in a LINITEST apparatus for 30 minutes at 40° C. To evaluate the bleaching results, the increased brightness DY of the stains (difference in brightness according to CIE) brought about by the treatment is used. Table 3 contains the DY values for the systems investigated. The structures of the compounds (1a) and (3a) are given in Example 1. The concentrations are concentrations in the washing liquor.

TABLE 3

| DY with 8.6 mmol/L of $H_2O_2$ | DY with 8.6 mmol/L of $H_2O_2$ + 5 μmol/L of (1a) | DY with 8.6 mmol/L of $H_2O_2$ + 50 μmol/L of (1a) | DY with 8.6 mmol/L of $H_2O_2$ + 5 μmol/L of (1a) + 45 μmol/L of (3a) |
|---|---|---|---|
| 16.5 | 17.1 | 16.2 | 19.0 |

EXAMPLE 4

The novel mixtures on average cause less damage to the dyed washing goods than the pure manganese complexes, while having the same or better DTI- and bleaching effects. With respect to dye damage, an on average even slightly lower dye loss is found—even when using dyes known to be very sensitive—than in the case of a TAED-activated bleaching system. The latter is regarded as state of the art in the area of oxygen bleaching with an accepted damage/utility balance. Table 4 shows the dye losses in percent after the three systems have been treated five times when used as described in Example 3.

TABLE 4

| test dyeing | Dye loss % | | |
|---|---|---|---|
| | 8.6 mmol/L of $H_2O_2$ + 50 μmol/L of (1a) | 8.6 mmol/L of $H_2O_2$ + 5 μmol/L (1a) + 45 μmol/L of (3a) | 8.6 mmol/L of $H_2O_2$ + 1.3 mmol/L of TAED |
| Vat Brown 001 | 0 | 5 | 0 |
| Reactive Brown 017 | 15 | 10 | 15 |
| Reactive Red 123 | 15 | 10 | 15 |
| Direct Blue 085 | 20 | 15 | 15 |

EXAMPLE 5

With regard to fibre damage on dyed materials, the novel mixtures on average have a balance similar to that of the cited TAED system and the manganese complexes themselves. Table 5 shows the relative DP-reduction after treating three systems five times when used as described above.

TABLE 5

| test dyeing | DP-Reduction % | | |
|---|---|---|---|
| | 8.6 mmol/L of $H_2O_2$ + 50 μmol/L (1a) | 8.6 mmol/L of $H_2O_2$ + 5 μmol/L (1a) + 45 μmol/L (3a) | 8.6 mmol/L of $H_2O_2$ + 1.3 mmol/L TAED |
| Vat Brown 001 | 20 | 0 | 20 |
| Reactive Brown 017 | 5 | 10 | 5 |
| Reactive Red 123 | 25 | 10 | 5 |
| Direct Blue 085 | 0 | 10 | 0 |

What is claimed is:

1. A process for washing and cleaning as well as for preventing the reabsorption of migrating dyes in a washing liquor, which process comprises adding to a washing liquor which comprises a peroxide-containing washing agent, 0.5 to 150 mg per liter of the washing liquor of a mixture consisting of 2 to 85% by weight of a manganese complex which is a compound of formula (1)

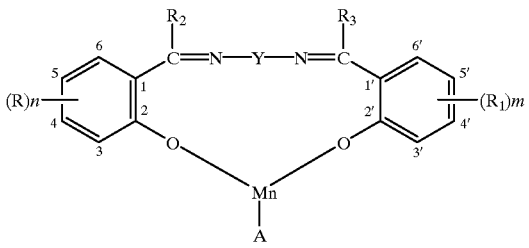

or

-continued (2)

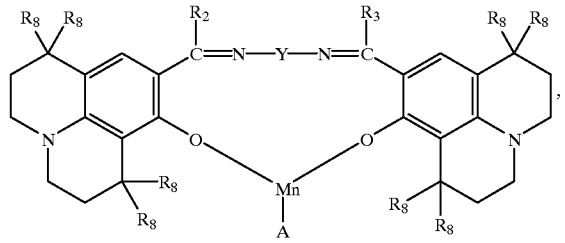

wherein

A is an anion;

n is 0, 1, 2 or 3, m is 0, 1, 2 or 3, $R_4$ is hydrogen or linear or branched $C_1$–$C_4$alkyl, $R_8$ is hydrogen or linear or branched $C_1$–$C_4$alkyl, Y is a linear or branched alkylene radical of formula —$[C(R_4)_2]_r$—, wherein r is an integer from 1 to 8 and the $R_4$ groups have each independently of one another the meanings cited above;

—CX=CX—, wherein X is cyano, linear or branched $C_1$–$C_8$alkyl or di(linear or branched $C_1$–$C_8$alkyl) amino, —$(CH_2)_q$—$NR_4$—$(CH_2)_q$—, wherein $R_4$ has the meaning cited above, and q is 1, 2, 3 or 4; or a 1,2-cyclohexylene radical of formula:

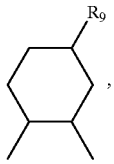

or a 1,2-aryl radical of formula

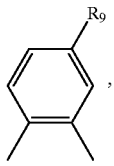

wherein $R_9$ is hydrogen, $SO_3H$, $CH_2OH$ or $CH_2NH_2$,

R and $R_1$ are each independently of the other cyano, halogen, $OR_4$ or $COOR_4$, wherein $R_4$ has the meaning cited above, nitro, linear or branched $C_1$–$C_8$alkyl, linear or branched partially fluorinated or perfluorinated $C_1$–$C_8$alkyl, $NR_5R_6$, wherein $R_5$ and $R_6$ *are* identical or different and are each hydrogen or linear or branched $C_1$–$C_{12}$alkyl, or linear or branched $C_1$–$C_8$alkyl-$R_7$, wherein $R_7$ is $NH_2$, $OR_4$, $COOR_4$ or $NR_5R_6$, which have the meanings cited above, or —$CH_2$—$N^{\oplus}R_4R_6R_7$, or —$N^{\oplus}R_4R_5R_6$, wherein $R_4$, $R_5$ and $R_5$ have the meanings cited above, $R_2$ and $R_3$ are each independently of the other hydrogen, linear or branched $C_1$–$C_4$alkyl or unsubstituted aryl, or aryl which is substituted by cyano, halogen, $OR_4$or $COOR_4$, wherein $R_4$ is hydrogen or linear or branched $C_1$–$C_4$alkyl, by nitro, linear or branched $C_1$–$C_8$alkyl, $NHR_5$ or $NR_5R_6$; wherein $R_5$ and $R_6$ are identical or different and are each hydrogen or linear or branched $C_1$–$C_{12}$alkyl, or by linear or branched $C_1$–$C_8$alkyl-$R_7$, wherein $R_7$ is $NH_2$, $OR_4$, $COOR_4$ or $NR_5R_6$, which have the meanings cited above, or by $—N^{\oplus}R_4R_5B_6$, wherein $R_4$, $R_5$ and $R_6$ have the meanings cited above, and 98 to 15% by weight of an organic ligand of the formula (3)

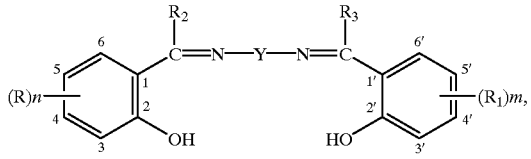

(4)

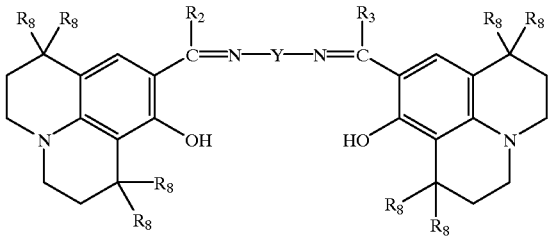

(5)

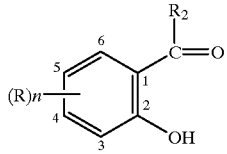

or (6)

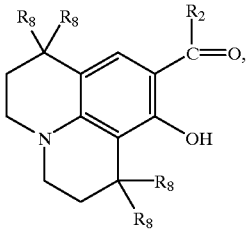

wherein R, $R_1$, $R_2$, $R_3$, $R_8$, Y, n and m are as defined above, the percentages being based on the entire weight of the mixture.

2. A process according to claim 1, which comprises adding 1.5 to 75 mg of the mixture of manganese complex and organic ligand per liter of washing liquor.

3. A process according to claim 1, which comprises adding 1.5 to 30 mg of the mixture of manganese complex and organic ligand per liter of washing liquor.

4. A process according to claim 1, which comprises adding a manganese complex of formula (1) or (2), wherein Y is a radical of formula $—(CH_2)_r—$, wherein r is an Integer from 1 to 8, or of formula $—C(R_4)_2—(CH_2)_p—C(R_4)_2—$, wherein p is a number from 0 to 6 and the $R_4$ groups are each independently of one another hydrogen or $C_1$–$C_4$alkyl, or a 1,2-cyclohexylene radical or a 1,2-phenylene radical.

5. A process according to claim 1, which comprises adding a manganese complex of formula (1) or (2), wherein R and $R_1$ are hydrogen, chloro, $OR_4$, $COOR_4$, $N(R_4)_2$ or $N^{\oplus}(R_4)_3$, wherein in $N(R_4)_2$ or $N^{\oplus}(R_4)_3$ the $R_4$ groups may be different and are hydrogen or $C_1$–$C_4$alkyl.

6. A process according to claim 1, which comprises adding a manganese complex of formula (1) or (2), wherein $R_2$ and $R_3$ are hydrogen, methyl, ethyl or unsubstituted phenyl.

7. A process according to claim 1, which comprises adding a ligand of formula (3) or (4), wherein Y is a radical of formula $—(CH_2)_r—$, wherein r is an integer from 1 to 8, or of formula $—C(R_4)_2—(CH_2)_p—C(R_4)_2—$, wherein p is a number from 0 to 6, and the $R_4$ groups are each independently of one another hydrogen or $C_1$–$C_4$alkyl, or Y is a 1,2-cyclohexylene radical or a 1,2-phenylene radical.

8. A process according to claim 1, which comprises adding a ligand of formula (3), (4), (5) or (6), wherein R and $R_1$ are hydrogen, $OR_4$, $COOR_4$, $N(R_4)_2$ or $N^{\oplus}(R_4)_3$, wherein in $N(R_4)_2$ or $N^{\oplus}(R_4)_3$ the $R_4$ groups may be different and are hydrogen or $C_1$–$C_4$alkyl.

9. A process according to claim 1, which comprises adding a ligand of formula (3), (4), (5) or (6), wherein $R_2$ and $R_3$ are hydrogen, methyl, ethyl or unsubstituted phenyl.

10. A process according to claim 1, wherein the ratio $$V = \frac{\text{entire amount of the manganese complexes in the mixture}}{\text{entire amount of the organic ligands in the mixture}}$$

is from 0.02 to 5, the amounts relating to molar amounts.

11. A washing agent, which comprises

I) 5–90% A) of an anionic surfactant and/or B) of a nonionic surfactant,

II) 5–70% C) of a builder substance,

III) 0.1–30% D) of a peroxide, and

IV) 0.005–2% E) of a mixture of a manganese complex of formula (1) or (2) and an organic ligand of formula (3), (4), (5) or (6), as defined in claim 1, the percentages being by weight based on the entire weight of the washing agent.

* * * * *